United States Patent [19]

Infanger

[11] Patent Number: 4,867,429

[45] Date of Patent: Sep. 19, 1989

[54] APPARATUS FOR STUFFING AT LEAST ONE INSERT INTO PRINTED PRODUCTS

[75] Inventor: Rudolf Infanger, Hinwil, Switzerland

[73] Assignee: Ferag AG, Hinwil, Switzerland

[21] Appl. No.: 222,902

[22] Filed: Jul. 22, 1988

[30] Foreign Application Priority Data

Jul. 30, 1987 [CH] Switzerland ..... 02917/87

[51] Int. Cl.[4] ..... B65H 5/30

[52] U.S. Cl. ..... 270/55

[58] Field of Search ..... 270/54, 55, 56, 57, 270/58

[56] References Cited

U.S. PATENT DOCUMENTS

| | | | |
|---|---|---|---|
| 3,580,652 | 5/1971 | Reist | 270/54 |
| 4,058,202 | 11/1977 | Reist | 270/55 |
| 4,398,710 | 8/1983 | Hänsch | 270/55 |
| 4,416,448 | 11/1983 | Meir | 270/55 |
| 4,709,910 | 12/1987 | Honegger | 270/55 |
| 4,729,554 | 3/1988 | Honegger | 270/55 |

*Primary Examiner*—Robert E. Garrett
*Assistant Examiner*—Therese M. Newholm
*Attorney, Agent, or Firm*—Werner W. Kleeman

[57] ABSTRACT

A displacement device is arranged at an input section of a stuffing apparatus for stuffing at least one insert into folded printed products. The displacement device mutually displaces relative to one another two main printed products which have been infed in superposed or mutually reposing relationship upon one another in a predeterminate product conveying direction before these two main printed products are engaged by a transport device and further delivered to an infeed section of the stuffing apparatus. For this purpose, one printed product is fixedly retained by a clamping element controlled by a cam whereas the other printed product is displaced by a displacement or slide element in the product conveying direction. The displacement or slide element is actuated by a drive arrangement comprising an entrainment lever upon which acts a stop or abutment of the transport device during its return motion. The drive arrangement converts the return movement of the transport device into a displacement motion of the displacement or slide element in the product conveying direction.

21 Claims, 5 Drawing Sheets

APPARATUS FOR STUFFING AT LEAST ONE INSERT INTO PRINTED PRODUCTS

BACKGROUND OF THE INVENTION

The present invention relates to a new and improved construction of a stuffing or insertion apparatus for the stuffing or insertion of at least one insert into printed products, especially for the stuffing of at least one insert into folded main printed products.

Generally speaking, the stuffing apparatus of the present invention is of the type comprising a transport or feed device for the conjoint transport of, generally in each case, two printed products which are superposed or lying or reposing upon one another, along a predeterminate processing path. There is also provided a displacement or shifting device for the displacement or shifting of the printed products relative to one another during the course of the product movement along the predeterminate processing path.

Such type of stuffing apparatus is known to the art from Swiss Pat. No. 649,267, and the cognate U.S. Pat. No. 4,416,448, granted Nov. 22, 1983. In such prior art stuffing apparatus, in each case two superposed printed products are conjointly transported along a processing path, then are opened in succession and there is introduced an insert into each momentarily formed product opening. In order to be able to open the printed products which lie upon one another, the leading edge of one of the printed products is freed or exposed. This operation is accomplished in that the transport device during its return movement entrains a printed product through a certain path of travel, whereas the other printed product is prevented from being entrained in the direction of the returning transport device by the provision of a stop or abutment member. It should be readily evident that with this heretofore known construction of stuffing apparatus the displacement of two mutually reposing thin printed products can lead to difficulties. The stop of abutment member over which travels the entrained product, in such case, only may protrude to a slight extent so as not to damage the second or other printed product and yet it must protrude sufficiently to ensure that the first printed product is positively held back or retained. Hence, with these prerequisites in mind, it is necessary when processing thicker printed products to accommodate and positionally adjust or set the stop or abutment member. The same is analogously true when converting the stuffing apparatus so as to work with thinner products instead of prior processed thicker printed products. Consequently, the stuffing apparatus must undergo time-consuming adjustment or setting work before it can be placed into operation.

SUMMARY OF THE INVENTION

Therefore with the foregoing in mind it is a primary object of the present invention to provide a new and improved construction of a stuffing apparatus of the previously mentioned type which does not suffer from the aforementioned drawbacks and shortcomings of the prior art constructions of stuffing apparatus.

Another and more specific object of the present invention, aims at the provision of a new and improved construction of a stuffing apparatus for stuffing or inserting at least one insert into folded products, typically folded printed products, especially for the stuffing of at least one insert into folded main printed products, wherein it is possible to positively and protectively mutually displace printed products of the most different thicknesses without the need for undertaking prior adjustment or setting work at the stuffing apparatus.

Yet a further significant object of the present invention, is directed to a new and improved construction of stuffing apparatus for stuffing inserts into products, especially main printed products, wherein the main printed products present in product pairs reposing upon one another or disposed in contacting side-by-side relationship can be mutually shifted so as to facilitate opening of each of the main printed products for the reliable insertion of at least one insert into such main printed product.

A further noteworthy object of the present invention is concerned with an improved construction of stuffing apparatus for stuffing inserts or the like into printed products, which stuffing apparatus is relatively simple in construction and design, extremely reliable in operation, not readily subject to breakdown and malfunction, requires a minimum of maintenance and servicing, and allows handling of printed products of different thicknesses without the need to accomplish prior adjustment or setting operations at the stuffing apparatus when switching from processing one product thickness to a different product thickness.

Now in order to implement these and still further objects of the invention which will become more readily apparent as the description proceeds, the stuffing apparatus of the present development is manifested, among other things, by the features that the displacement or shifting device comprises a clamping element which can be brought into contact with an outer surface of one of the printed products and a displacement or slide or pushing element which can be brought to act upon the outer surface of the other printed product.

The mutually reposing or superposed printed products are retained by the clamping element and the displacement or slide element and displaced in relation to one another. Since both of these elements, the clamping element and the displacement or slide element, act or engage at the outer surfaces of the printed products, the contact or force-application surface of each such clamping element and displacement or slide element can be designed to be relatively large. This, in turn, results in lesser loading of the printed products and, in particular, protection of the edges of such printed products. The thickness of the printed products does not have any affect upon the size of the contact surfaces.

The clamping element is preferably pivotable about an axis disposed substantially parallel to the product processing path for the printed products and is mounted to be pre-biased or loaded in the direction of the product clamping location where there engages the clamping element. A cam control can place the clamping element into its opened position. With this design there is afforded a positive holding or retention of the printed products which is independent of the thickness of the printed products.

The displacement or slide element preferably comprises a displacement or slide member or slide which is mounted to be displaceable substantially parallel to the processing path for the printed products. A drive arrangement acts upon the displacement or slide element and can be operated by return movement of the carriage or carriage structure of the transport or feed device. This return movement of the transport or feed device is thus beneficially exploited in order to mutually shift the printed products in relation to one another.

According to a preferred embodiment of the stuffing apparatus of the present development, the clamping element as well as the displacement or slide element are each provided or covered with a contact or support element or cover possessing large coefficients of friction, preferably formed of rubber or a suitable plastics material. Consequently, there is guaranteed the positive displacement or retention, as the case may be, of the printed products. The surfaces of the contact or cover elements are advantageously structured so as to possess a profiled configuration, such as a sawtooth-like structure which further augments the frictional entrainment of the products.

According to a further preferred constructional embodiment an entrainment lever of the drive arrangement can be pivoted or rocked out of the region of the carriage of the transport device. In this way there can be disconnected or rendered ineffectual the displacement or shifting device in a very simple manner.

This displacement or shifting device is most preferably arranged at a product input section of a revolvingly driven cell wheel or unit of the stuffing apparatus. This revolvingly driven cell wheel contains radially extending pockets or cells—also sometimes referred to as compartments—for the reception of the printed products and at least two infeed sections which follow one another and the input section in axial direction of the stuffing apparatus. These at least two infeed sections serve for the infeed of the product inserts or supplements or the like. Also arranged in axial direction of the stuffing apparatus and following the at least two infeed sections for the inserts or supplements is a product removal or delivery section at which there can be removed the processed printed products. With the inventive design of the stuffing apparatus there is realized a space-saving arrangement of the displacement or shifting device and such also can be retrofitted into existing cell wheels.

According to a further preferred construction, the clamping element is arranged at a rear wall of an associated pocket or cell and the displacement or slide element at a front wall of such pocket or cell. Both of these elements, namely the clamping element and the displacement element, can assume the function of limiting or boundary pocket walls, thus extremely simplifying the construction of the inventive stuffing apparatus.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
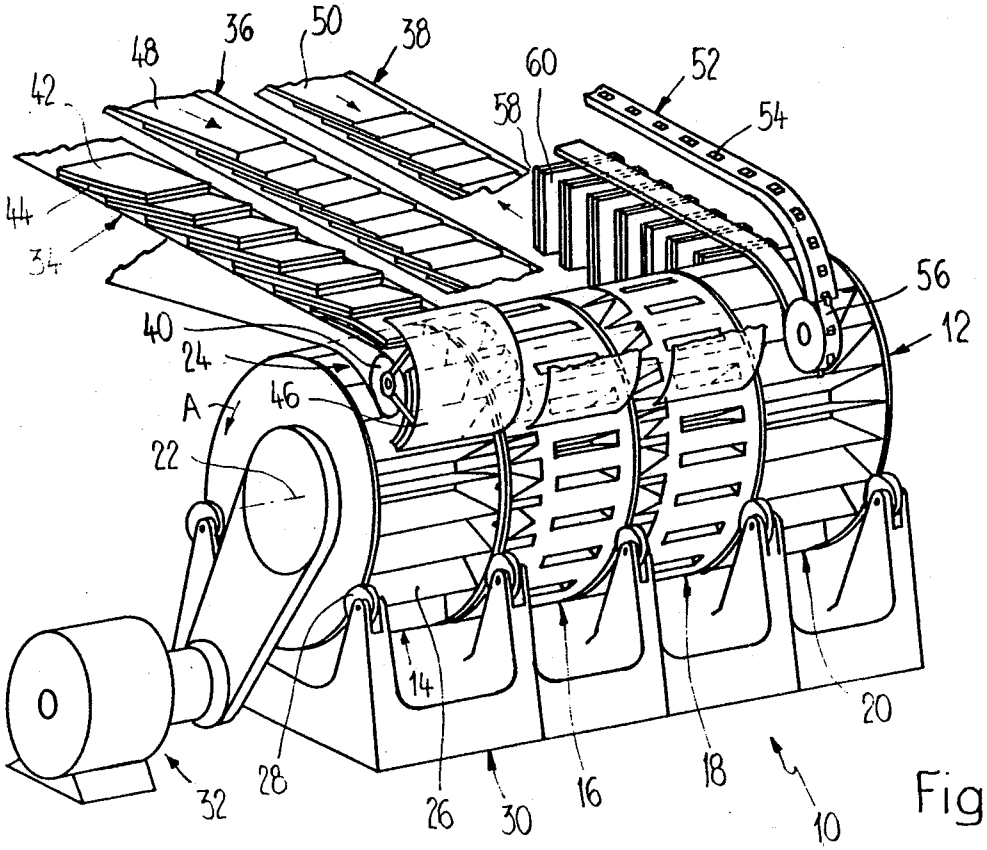
FIG. 1 is a simplified perspective illustration of a stuffing apparatus for stuffing or inserting inserts or supplements or the like into main printed products.

Describing now the drawings, it is to be understood that to simplify the showing thereof, only enough of the construction of the stuffing apparatus of the present development has been illustrated therein as is needed to enable one skilled in the art to readily understand the underlying principles and concepts of this invention. Turning now specifically to the drawings, the stuffing apparatus 10 as schematically illustrated in FIG. 1, is extensively of known design and details thereof have been described in Swiss Pat. No. 575,303, and the cognate U.S. Pat. No. 4,058,202 granted Nov. 15, 1977 and Swiss Pat. No. 584,153, and the cognate U.S. Pat. No. 3,951,399, granted Apr. 20, 1976, to which reference may be readily had and the disclosure of which is incorporated herein by reference. Therefore, to simplify the understanding of the stuffing apparatus 10 in the description to follow, there will be only considered essential details of the design of the known construction and known mode of operation of such stuffing apparatus.

At this juncture it is noted that a primary component or part of the stuffing apparatus 10 is a substantially horizontal, elongate or extended cell wheel or cell wheel unit 12. Such cell wheel 12 is subdivided into a number of sections or portions 14, 16, 18 and 20, which are arranged adjacent or in juxtaposed relationship in the direction of the lengthwise or longitudinal axis 22 of the cell wheel or cell wheel unit 12 and are rigidly connected for rotation with one another, as is quite well known in this technology. At an input section 14 there merge two infeed sections 16 and 18 and a removal or delivery section 20. Each section 14, 16, 18 and 20 contains radially outwardly open pockets or cells or compartments 24 which are separated from one another by the pocket or cell walls 26. The cell wheel 12 is rotatably supported upon rolls or rollers 28 which are mounted to be freely rotatable in a lower or sub-frame 30. As schematically indicated in FIG. 1, the cell wheel or cell wheel unit 12 is driven by a suitable drive or drive means 32 in the direction of the arrow A about its lengthwise axis 22.

A suitable respective transport or conveyor device 34, 36 and 38 leads to the associated input section 14 and each infeed section 16 and 18, respectively. Each of these transport or conveyor devices 34, 36 and 38 travels above the associated cell wheel section 14, 16 and 18, respectively. Each transport device 34, 36 and 38 is equipped with conventional and therefore not particularly illustrated clamping elements or clamps, also referred to in the art as grippers or gripper elements, which are arranged at a predeterminate mutual spacing from one another. Moreover, each transport device 34, 36 and 38 is guided about an associated deflection wheel or roll 40, the latter having only been conveniently shown for the transport or conveyor device 34.

This transport or conveyor device 34 here serves to generally infeed or deliver in each case two main or primary printed products 42 and 44 which are superposed or mutually lying on top of one another and which are inputted in an imbricated formation or stream and fed as respective product pairs 42, 44 to the input section 14. As to the printed products 42 and 44, such may typically comprise single or multi-sheet parts or sections of newspapers, periodicals, magazines or the like, which have been folded at least once. The not particularly illustrated clamps or gripper elements engage the printed products 42 and 44, in other words, each printed product pair 42, 44 at its rear edge viewed in the depicted conveying direction indicated by the not particularly referenced arrows of FIG. 1, and specifically, here the printed product pairs 42, 44 are each engaged at the product region or portion constituting the cut portion or flower which is located remote from the product fold.

After the printed products 42 and 44, here after each printed product pair 42, 44 has travelled about the deflection wheel or roll 40 and the deflection member 46, for instance a sheet metal deflection plate, each such pairs of printed products 42, 44 assume a suspended posture or position and in such suspended posture extend into the pockets or cells 24 of the input section 14 of the stuffing apparatus 10. By opening the clamps or gripper elements of the transport or conveyor device 34 the printed products or product pairs 42, 44 are released, resulting in each pair of printed products 42, 44 dropping down onto the base or floor of the associated pocket or cell 24. Pre-products 48 and 50, here referred to as inserts or supplements, are delivered in corresponding fashion to the infeed sections 16 and 18 by the associated transport or conveyor devices 36 and 38, respectively.

An overhead transport or conveyor device 52 or equivalent structure is likewise operatively associated with the product removal or delivery section 20 of the stuffing apparatus 10. This transport or conveyor device 52 also possesses clamps or gripper elements 54 arranged at a mutual spacing from one another and is guided about a deflection wheel or roll 56.

The clamps or gripper elements 54 engage in known fashion, as disclosed for instance in the aforementioned Swiss Pat. No. 649,267 and the cognate U.S. Pat. No. 4,416,448, to which reference may be readily had and the disclosure of which is incorporated herein by reference, in each case both of the final or end products 58 and 60 which repose upon one another in each pocket or cell 24 of the removal or delivery section 20 and lift such end or final products 58 and 60 out of the associated pocket or cell 24 of the stuffing apparatus 10. The end or final products 58 and 60 which are further transported in a suspended posture or position, as illustrated in FIG. 1, can now be delivered so that they can be further processed as desired.

In each cell or pocket 24 of the input section 14, there are introduced two main printed products 42 and 44. As will be explained more fully hereinafter, these main printed products 42 and 44 are displaced or shifted conjointly and while reposing upon one another in axial direction of the cell wheel or cell wheel unit 12 towards the product removal or delivery section 20 thereof. During the course of such product movement there is introduced into each of the printed products 42 and 44 an associated pre-product or insert 48 and 50, respectively, as explained previously. The end or final products 58 and 60 which are provided with these related pre-products or inserts 48 and 50 are then again conjointly removed from the removal or delivery section 20 of the stuffing apparatus 10.

Based upon the illustration of FIG. 2, there will now be explained in greater detail the product opening and insert stuffing operation. In the illustration of the stuffing apparatus 10 depicted in FIG. 2, there has not been taken into account the rotation of the cell wheel or cell wheel unit 12 in order to simplify the discussion. In reality, however, the printed products 42 and 44, in other words each product pair 42, 44, is not here moved along a linear path of travel as has been conveniently depicted in FIG. 2, but instead along a helical or screw-like travel path as is well known in this technology. The conjoint advance or forward feed of the printed products 42 and 44 from the input section 14 to the product removal or delivery section 20 is accomplished in the manner described in detail in the previously mentioned Swiss Pat. No. 575,303 and the corresponding U.S. Pat. No. 4,058,202 as well as in the Swiss Pat. No. 584,153 and the corresponding U.S. Pat. No. 3,951,399, granted Apr. 20, 1976. Therefore, as concerns the construction and operation of the transport or feed device for the advance or forward feed of the printed products 42 and 44, which has not or only partially been shown in the figures of the drawings, reference thus can be made, to the extent needed, to the aforementioned patent documentation.

Figure 2:
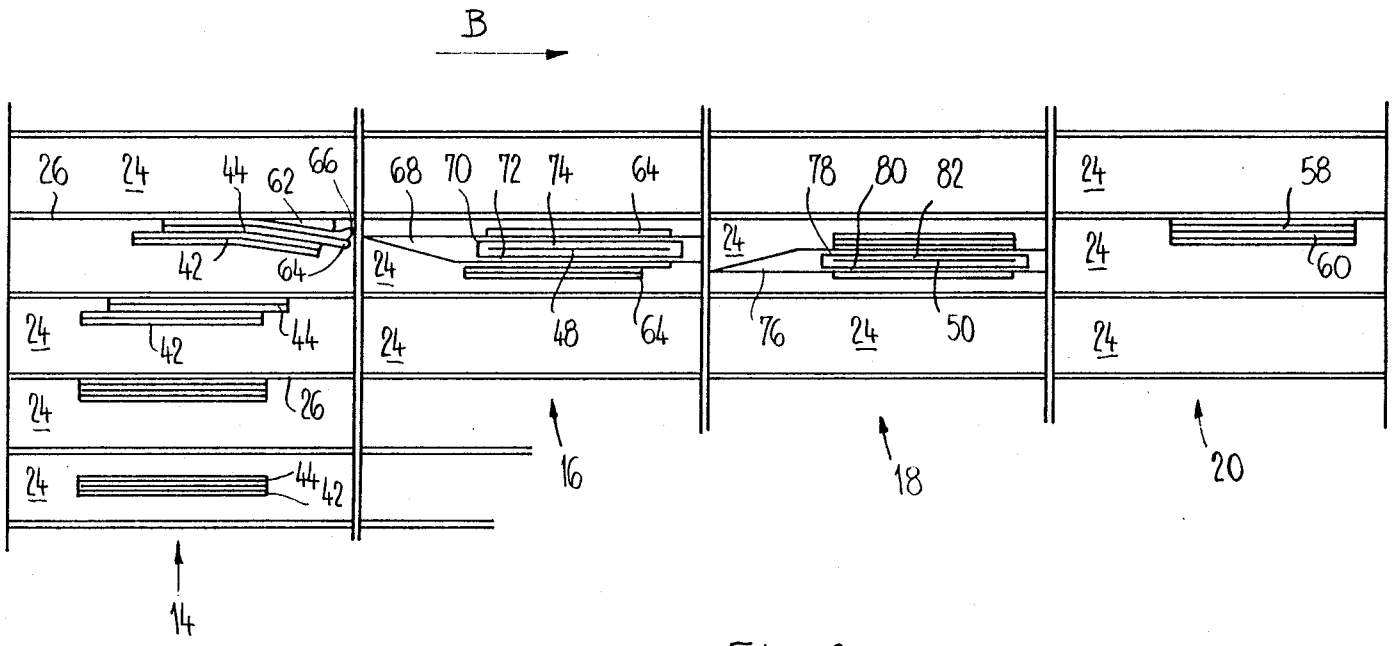
FIG. 2 is a top plan view of a portion of the cell wheel of the stuffing apparatus depicted in FIG. 1, wherein the progress of the stuffing operation has been illustrated in timewise staggered fashion.

The printed products 42 and 44 which are introduced in product pairs 42, 44 in the abovedescribed manner into the pockets or cells 24 of the input section 14, during rotation of the cell wheel 12, come to bear upon a pocket or cell wall or wall member 26, as will be evident from the illustration of FIG. 2. Thereafter, the printed product 44 is displaced or shifted in the product conveying or conveyance direction B in relation to the other printed product 42, as such will be explained in greater detail at a later point of this disclosure. During the subsequent conjoint transport or feed of both of the printed products 42 and 44, in other words, each printed product pair 42, 44, in the product conveying or conveyance direction B along a predeterminate product processing path, each such printed product pair 42, 44 comes into contact with a substantially wedge-shaped contact or support element 62 which is secured at such pocket or cell wall 26. This wedge-shaped contact or support element 62 raises the therewith contacting pair of printed products 42, 44 at the leading region thereof somewhat away from the associated pocket or partition wall 26, as shown at the left-hand side of FIG. 2. Opening of the printed product 44 at its leading edge 64 is accomplished in conventional fashion, as disclosed, for instance, in Swiss Pat. No. 644,814 and the cognate U.S. Pat. No. 4,398,710, as well as Swiss Pat. No. 644,815 and the cognate U.S. Pat. No. 4,420,146, the disclosure of which thus is incorporated herein by reference. The opening formed in the printed product 44 has been generally designated by reference numeral 66 in FIG. 2.

The printed products 42 and 44, during their conjoint advance or forward feed in the product conveying direction B, arrive at the neighboring pocket or cell 24 of the infeed section 16. In each pocket or cell 24 of this infeed section 16 there is located a stationary separating element, here shown as a separation wedge 68, upon which travels the printed product 44. This separation wedge or wedge member 68 engages into the formed opening 66 of the printed product 44 and during the further movement of the printed product pair 42, 44 perfects a complete opening of both halves or portions of the printed product 44. The now opened printed product 44 is retained in its opened condition by the guide members or guides 70, 72 for instance sheet metal guides, which merge with the separation wedge or wedge member 68. Now a pre-product or insert 48 or the like is introduced into the open printed product 44 through an infeed opening 74 which communicates with the space formed between the sheet metal guide members or guides 70, 72.

During the opening of the printed product 44 and the insertion or stuffing of the pre-product or insert 48, there is co-transported the other printed product 42 without it, however, being subjected to any processing operation. Prior to the time that both of the printed products 42 and 44, in other words, the printed product pair 42, 44 are forwarded or transported to the next infeed section 18, each such printed product pair 42, 44 is aligned, for instance as disclosed in the aforementioned Swiss Pat. No. 575,303 and the cognate U.S. Pat. No. 4,058,202, such that the leading edges 64 of both printed products 42 and 44, as viewed in the product conveying or conveyance direction B, are arranged at the same height, in other words are squared-up in position. After the insertion of the pre-product or insert 48 into the printed product 44 and the product alignment of both of the printed products 42 and 44, there is accomplished in analagous fashion a pre-opening of the second printed product 42, as such has been previously explained in conjunction with the opening operation for the printed product 44.

During the conjoint further movement or forwarding of both of the printed products 42 and 44 the printed product 42 travels onto a separation element, here shown again as a separation wedge or wedge member 76 which is arranged in the neighboring pocket or cell 24 of the second infeed section 18. This separation wedge 76, comparable to the operation of the previously discussed separation wedge 68, perfects a complete opening of the printed product 42 by being inserted into an opening 66 which has formed in the printed product 42. This now opened printed product 42 is retained in its opened state by guide members or guides 78, 80, for instance formed of sheet metal, which merge with the separation wedge 76. Here also a pre-product or insert 50 is inserted or stuffed into the open printed product 42 through an infeed opening 82 which communicates with the space formed between the sheet metal guide members or guides 78 and 80. During the advance or forward feed of the printed products 42 and 44 from the infeed section 16 into the infeed section 18, the printed product 44 moves away from the associated sheet metal guide members or guides 70 and 72 and is closed. Now both of the printed products 42 and 44, each provided with an associated pre-product or insert 48 and 50, respectively, are transported from the infeed section 18 to the product removal or delivery section 20. During such displacement or shifting of the printed products 42 and 44, the printed product 42 travels off of the associated sheet metal guide members or guides 78 and 80 and closes. The mutually reposing or superposed end or final products 58 and 60 are, as explained above, extracted by the transport or conveyor device 52 out of the pockets or cells 24 of the product removal or delivery section 20 and further transported for subsequent processing or handling as desired.

Based now upon the illustration of FIGS. 3, 4, 5 and 6, there will be described in greater detail the construction and mode of operation of an exemplary embodiment of displacement or shifting or slide device 84 by means of which both of the printed products 42 and 44, in other words, each printed product pair 42, 44 can be displaced or shifted relative to one another within the input section 14.

Figure 3:
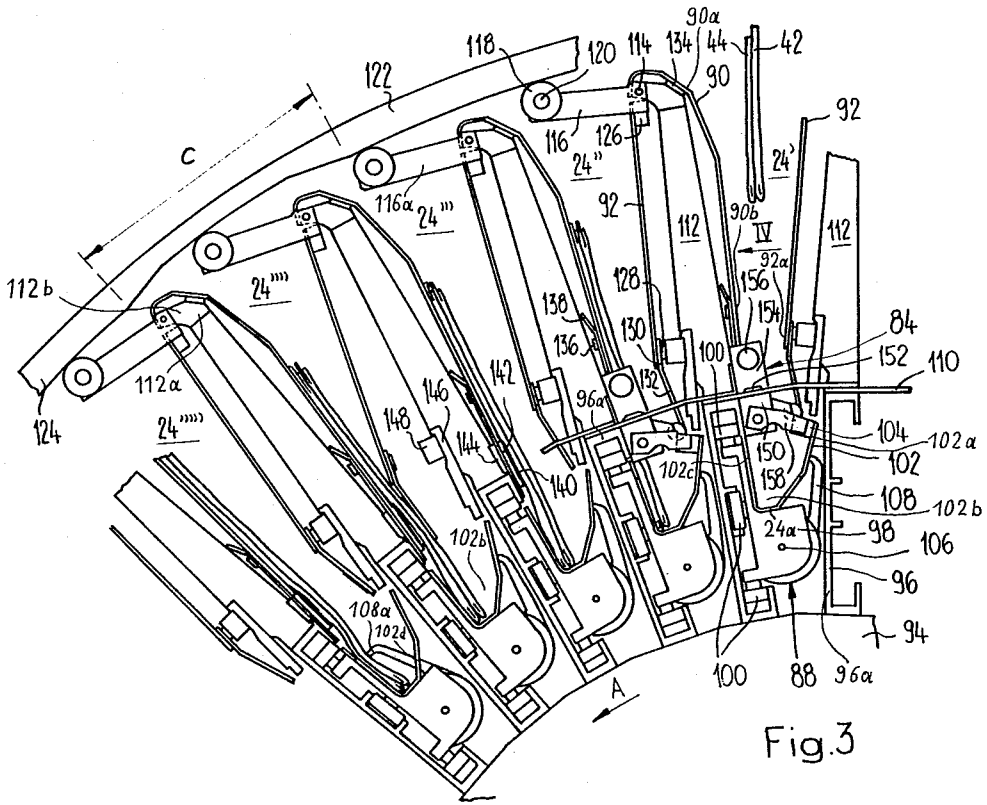
FIG. 3 is a partially simplified side view of a portion of the cell wheel of the stuffing apparatus depicted in FIG. 1.
Figure 4:
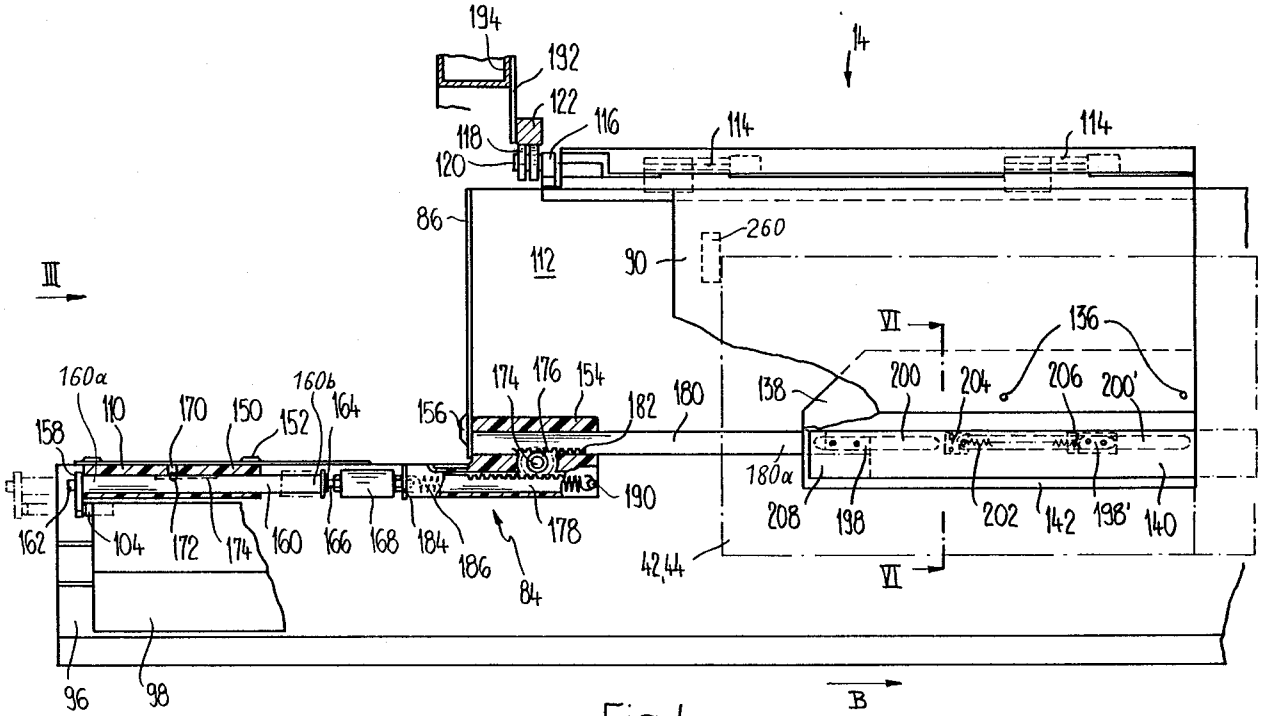
FIG. 4 is a front view of the cell wheel shown in FIG. 3 looking in the direction of the arrow IV thereof.

FIG. 3 illustrates in side view, looking in the direction of the lengthwise or longitudinal axis 22 of the cell wheel or cell wheel unit 12 (see also FIG. 1) that portion of the input section 14 of such cell wheel 12 where the printed products 42 and 44 or product pairs 42, 44 are introduced into the pockets or cells 24 and mutually displaced or shifted relative to one another. For purposes of revealing internal structure in FIG. 3, there has been conveniently removed the cover or closure member 86 which however is shown in FIG. 4. Furthermore, it is to be observed that in FIG. 3, and this is also true for FIG. 4, only those parts or components have been illustrated which are necessary for understanding the construction and mode of operation of the displacement or shifting device 84. As to the transport feed or conveyor device 88 serving for transporting the printed products 42 and 44 along the processing path, as noted previously reference should be made to the heretofore mentioned Swiss Pat. No. 575,303 and the cognate U.S. Pat. No. 4,058,202 which discloses the same.

Focussing again first upon FIG. 3 in detail, there have been illustrated five pockets or cells 24', 24'', 24''', 24'''' and 24''''' of the input section 14. Each of the pockets or cells, generally indicated by reference numeral 24 in FIGS. 1 and 2, comprises a front pocket wall or portion 90 and a rear pocket wall or portion 92 as clearly shown in FIG. 3, each such pocket wall or portion 90 and 92 being formed, for instance, of sheet metal or metal plating, and there is also shown the transport or feed or conveyor device 88. At an only partially depicted support ring or ring member 94 which is rotatably mounted for rotation about the lengthwise axis 22 of the cell wheel 12, there are arranged profile rails or rail members 96 or equivalent structure which protrude radially outwardly and extend in the lengthwise direction of the cell wheel or cell wheel unit 12. These profile rails 96 each comprise a substantially C-shaped profile member **96*a* and extend practically over the entire length or axial extent of the cell wheel 12 and are secured, for instance, by threaded bolts or equivalent fastening expedients at the support ring or ring member 94**.

A carriage or trolley member 98 or the like is displaceably mounted by means of rolls or rollers 100 in each profile rail or rail member 96. At this carriage or carriage member 98 there is arranged a substantially V-shaped guide member or guide 102, for instance formed of sheet metal or metal plating, which forms the base or floor **24*a* of the associated pocket or cell 24. Each such guide member or guide 102 has one leg portion or leg 102*a* which protrudes from the associated carriage or carriage member 98 and at which there is arranged an abutment or stop member 104. At the carriage 98 there is also pivotably mounted a pivotable shaft or shaft member 106 at which there are rigidly connected for rotation gripper fingers or finger members 108. The ends 108*a* of the gripper fingers 108, and which finger ends 108*a* protrude from the pivotable or pivotal shaft 106, are positioned, in an open state of the gripper fingers 108, externally of a space 102*b* formed by the substantially V-shaped legs 102*a* and 102*c* of the related guide member 102. On the other hand, when the gripper fingers 108 assume a product clamping position, they move through associated openings or recesses, merely generally indicated in FIG. 3 by reference character 102d of the related guide member 102 and come to bear upon the associated pair of printed products 42, 44**.

The profile rails 96 are interconnected with one another at their ends 96a located remote from the support ring or ring member 94, by means of cover or closure members 110, for instance likewise formed of sheet metal or metal plating. To preserve clarity in illustration the sheet metal cover members 110 at the region of the pocket or cell 24''' are shown in fragmentary or broken illustration and the cover members 110 which otherwise would be located at the region of the pockets 24'''' and 24''''' have not been shown at all. In the axial direction of the cell wheel 12 the sheet metal cover members 110 only extend or reach over a first limited portion of the profile rails or rail members 96, as will be apparent by referring to FIG. 4.

At each profile rail or rail member 96, there is appropriately secured a partition or separation wall or profile member 112. The free end 112a of the partition wall member or profile member 112 is forwardly offset or bent, viewed in the direction of rotation A in the cell wheel 12, to define a bent or offset portion 112b. Two torsion rods or rod or bar members 114 are connected at one end thereof with the bent portion 112b of the associated partition wall member 112 and at the other end are secured at a connection profile or profile 126. At each connection profile 126 there is arranged an actuation lever or lever member 116, at the free end 116a of which there is rotatably mounted a cam follower element or cam follower 118, here constituted by two cam follower rolls, at an associated stub shaft 120 or the like. The cam follower element or cam follower 118 bears against a stationary control member, here a cam or cam member 122 against the force of the torsion rods or bars 114. The stationary cam member or cam 122 coaxially encircles the cell wheel 12 at the region of the input section 114. A cam follower or control surface 124 of the cam member or cam 122, upon which slides or contactingly moves the cam follower element 118, is further spaced from the lengthwise axis 22 of the cell wheel 12 at a product clamping region C then along its remaining cam length. This affords a momentary or temporary deflection or turning of the actuation lever 116 in the clockwise direction or sense at the clamping region C. At the connection profile or profile member 126 there is rigidly connected for rotation therewith, the rear pocket wall 92. At the radially inwardly directed end 92a of this rear pocket wall 92 there is connected a rear insert or product clamping element 130, for instance formed of sheet metal or metal plating, by means of the threaded bolts 128. This rear insert element 130 is provided with a clamping support or contact surface 132. The function of the just considered clamping structure or unit 92, 114–132 will be described in greater detail hereinafter.

At the partition wall profile 112 there is likewise secured by means of the schematically depicted connection elements 134 the front sheet metal pocket wall 90. The upper region 90a of this front pocket wall 90 is bent or flexed, as shown, and covers the bent end 112b of the associated partition wall member or profile member 112. At the radially inwardly directed end 90b of the front pocket wall 90, there is secured by means of the threaded bolts 136 a front insert member 138, for instance formed of sheet metal or metal plating. At this front insert member 138 there is displaceably or shiftably mounted a slide or slide element 142 (see also FIG. 6), which will be discussed more fully hereinafter. This slide or slide element 142 is provided with a slide support or contact or cover surface 140. Between the front insert member 138 and the partition wall profile or profile member 112, there is arranged a support profile or profile member 144, as also seen by referring to FIG. 6. A tension profile member 146 is attached at the associated partition wall profile or profile member 112 opposite to the support profile or profile member 144. The function and operation of this tension profile member or profile 146 need not here be further discussed in this connection. It is mentioned, however, that at the tension profile member 146 there are secured abutment or stop elements 148 at which come to bear the threaded bolts 128 or the like, when the rear sheet metal pocket wall 92 is pivoted back into its open state.

At each cover member 110 there is attached a guide body or body member 150 by means of the threaded bolts 152, as particularly well seen by also referring to FIG. 4. A support or body member 154 is likewise secured by threaded bolts 156 or the like at the cover or closure member 86 which has not been shown in FIG. 3 but as previously noted appears in FIG. 4. An entrainment lever or lever member 158 which coacts with the impact or abutment member 104, the guide body 150 and the support body 154 are all components or parts of the displacement or shifting device 84 and will be considered more fully hereinafter during the detailed consideration of FIGS. 4 and 5.

Turning now to FIG. 4, it will be understood that such constitutes a partially sectional and fragmentary illustration in side view of the arrangement of FIG. 3 looking in the direction of the arrow IV thereof. In such FIG. 4 there has been illustrated, as far as the transport or feed device 88 is concerned, only the profile rail 96 and a part of the carriage or carriage member 98. The cover or closure member 110 connects the profile rail 96 with one of the neighboring profile rails 96 and there is secured thereto the guide body or body member 150 by means of the associated threaded bolts 152 or the like. Slidingly guided in the guide body 150 is a displacement rod or rod member 160. The entrainment lever or lever member 158 is rigidly connected for rotation by the threaded bolt or screw 162 or the like, with one end 160a of the displacement rod or rod member 160, whereas the other end 160b of this displacement rod 160 is operatively connected by an adjustment nut 164 and an adjustment bolt or screw 166 with a rotary joint or hinge means 168. The rotary joint or hinge means 168 is rotatably connected with the displacement rod 160 but cannot be displaced or shifted in axial direction. A spring-loaded ball or spherical or sphere member 172 is arranged in a bore 170 in the guide body or body member 150. This spring-loaded ball or sphere member 172 slides in a guide groove 174 provided in the displacement rod or rod member 160. This arrangement prevents any undesired rotation of the displacement rod 160 about its lengthwise axis. A not particularly visible guide recess or groove, arranged offset through an angle of about 120° with respect to the guide groove 174, is provided in the displacement rod or rod member 160. The purpose of this further guide recess or groove will be considered shortly in conjunction with the description of FIG. 5.

The partition wall profile or profile member 112 is arranged at the associated profile rail or rail member 96, wherein each such partition wall profile 112 is connected by the cover or closure member 86 with its neighboring partition wall profile 112. At the closure or cover member 86, there is secured by means of the threaded bolt 156 or the like, the support body or body member 154. The guide body or body member 150 as well as the support body or body member 154 are shown in sectional view in FIG. 4. A pinion 176 is rotatably mounted at a bearing shaft or shaft member 174. This pinion or pinion member 176 measures with a toothed rack or rack member 178 and also with teeth means 182 arranged at a plunger or plunger member 180. The toothed rack 178 is rotatable in conjunction with the rotary or rotational joint or hinge means 168 in the same manner as the displacement rod or rod member 160, but is non-displaceably connected in axial direction. A tension spring or spring member 186 is secured at an arm or overhang portion 184 of the toothed rack 178, and the opposite end of this tension spring 186 is operatively connected by means of a pin 190 with the support body 154.

The partition wall profile member 112 is covered by the front sheet metal pocket wall 90 at the region where the printed products 42 and 44 are introduced into the cell wheel 12. The torsion rods or bar members 114 are likewise covered. The cam member 122 is carried by an arm or overhang portion 192 which is attached at a frame 194 only a portion of which has been illustrated in FIG. 4.

At the fragmentarily shown front sheet metal pocket or cell wall or wall member 90, there is secured the front sheet metal insert member 138 by means of the threaded bolts or rivets 136. At the slide element 142, there are arranged slide shoes 198 and 198' which are displaceably guided in lengthwise guides or guide members 200 and 200' provided at the front insert member 138. A return spring or spring member 202 is connected at one end thereof at a holder element 204 likewise arranged at the front insert member 138 and the other end of this return spring 202 is connected with a block member or block 206 which is operatively connected with the slide or slide element 142. A slide support or contact or cover surface 140 is arranged upon the slide or slide element 142. The plunger 180 comes into contact at its end **180*a* located remote from the support or body member 154 with an impact or abutment element 208 of the slide element 142**.

In FIG. 4 there have been depicted in chain-dot or phantom lines both of the superposed or side-by-side positioned printed products or product pair 42, 44. Likewise shown in chain-dot or phantom lines, at the left-hand region of the illustration of FIG. 4, is the displacement or shifting device 84 which has moved into the actuation position.

Figure 5:
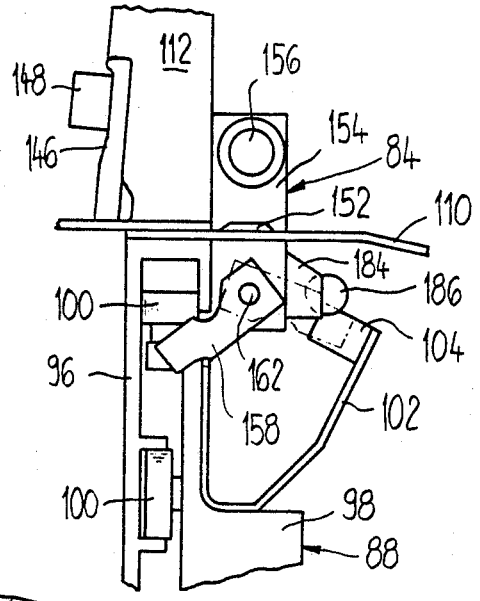
FIG. 5 is an enlarged illustration of a portion of the cell wheel depicted in FIG. 3.

FIG. 5 illustrates in an enlarged view in relation to the showing of FIG. 3 the displacement or shifting device 84 with the neighboring only partially illustrated components or parts. As noted previously, the reference characters used in FIG. 5 correspond with the reference numerals used for the same components or parts in the prior description of the other FIGS. 1 to 4. To the extent that certain of the depicted components or parts have already been described, no further discussion will be undertaken at this location. In the showing of FIG. 5, the entrainment lever or member 158 is here shown pivoted or rocked through an angle of about 120° in clockwise direction from the position depicted in full lines in FIGS. 3 and 4 and, in fact, from the comparable position shown however with chain-dot or phantom lines in such FIG. 5 into the depicted full line position. During pivoting of the entrainment lever member 158 and thus also the displacement rod or rod member 160 the ball or sphere member 172 is pressed against the spring force out of the guide groove 174 and latches into the previously discussed guide recess or groove as soon as the pivotal position depicted in full lines in FIG. 5 has been attained. Consequently, the entrainment lever member 158 has been pivoted out of the effective region of the abutment or stop member 104 and fixed in place and no longer can be actuated by such abutment or stop member 104.

Figure 6:
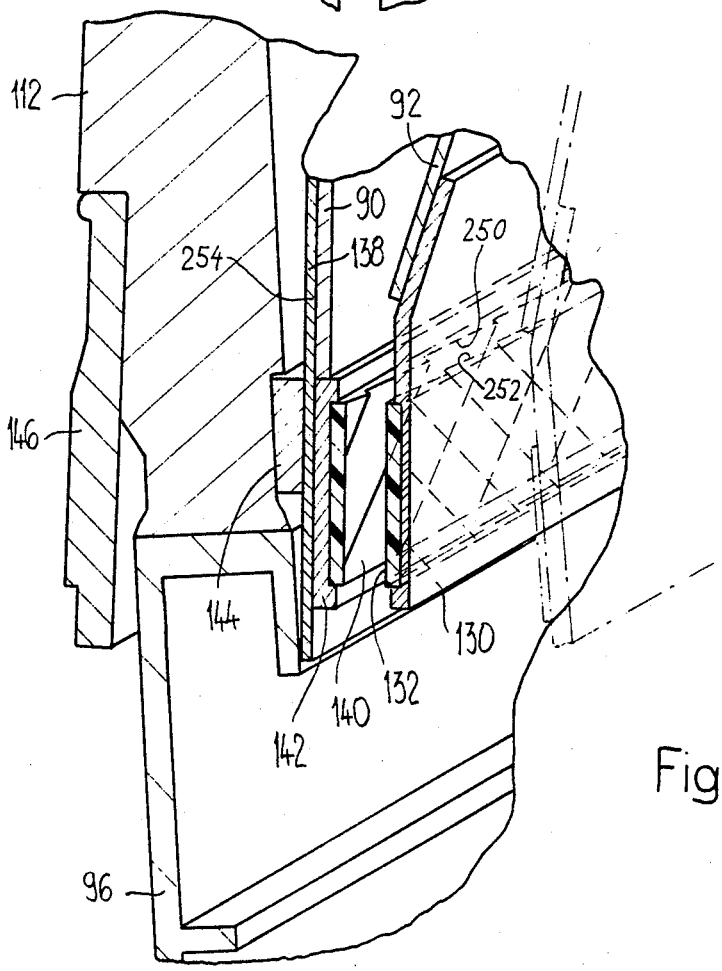
FIG. 6 is a sectional view, taken substantially along the line VI—VI of FIG. 4, in perspective illustration of part of the cell wheel depicted in FIG. 4.

FIG. 6 illustrates in perspective view a section along the section line IV—IV of FIG. 4, but wherein however, the transport or feed device 88 has not been shown. However, what has been illustrated in two positions are the components or parts which can move with the rear pocket or cell wall 92. The product clamping position which has been depicted in FIG. 6 in full lines, corresponds to the position of the clamping element 130 as the same has been shown in FIG. 3 in relation to the pocket or cell 24'''', whereas the chain-dot or phantom line depicted position of the clamping element 130 corresponds to the position of such clamping element in the other pockets or cells 24', 24'', 24''' and 24''''' of FIG. 3. What can be particularly well seen is the sawtooth-shaped inclined extending stepped portions 250 and 252 of the oppositely situated surfaces of the clamping support or contact member 132 and the slide support or contact member 140, respectively. These sawtoothed-shaped inclined extending stepped portions 250 and 252 are directed towards one another, as shown in FIG. 6 and section lines of the flank surfaces are inclined with respect to the product conveying direction B. Each of the clamping supports or covers 132 and slide supports or covers 140 are formed of a rubber or rubber-like or elastomeric material which possesses a high coefficient of friction in relation to that of paper. This high coefficient of friction as well as the surface structure or profiling of the clamping surface 132 and slide surface 140 results in a good force transmission between the clamping element and slide element to the therebetween clamped printed products or product pair 42, 44. The confronting surfaces, merely generally indicated by reference character 252 in FIG. 6 of the front insert member 138 and the slide element 142 are provided with a surface covering or coating having good sliding properties.

As was previously explained during the discussion of FIG. 2, by means of the displacement or shifting device 84 both of the main printed products 42, 44 are shifted in their mutual relative position with respect to one another at the input section 14 of the cell wheel 12 before each such main product pair 42, 44 is transported to the subsequent infeed section 16 of the cell wheel 12. This operation will now be considered more fully in conjunction with FIGS. 3 and 4. As has been described in the aforementioned Swiss Pat. No. 575,303 and the corresponding U.S. Pat. No. 4,058,202, the carriage or carriage member 98 or the like moves back-and-forth together with the parts or components arranged thereat in a direction substantially parallel to the lengthwise axis 22 of the cell wheel 12 along a predeterminate product processing path. Consequently, the carriage 98 conveys, in the product conveying or conveyance direction B, each associated pair of printed products 42, 44 located in the inlet section 14 to the infeed sections 16 and 18 and from that location, together with the now therein inserted pre-products or inserts 48 and 50 to the end product-removal or delivery section 20. Also the description of the actuation operation of the pivotal or pivotable shaft member 106 together with the gripper fingers 108 has been set forth in the above-listed patent documentation.

The cell wheel 12 rotates in the direction of the arrow A and the carriage 98 moves during its return motion opposite to the product conveying or conveyance direction B. The main or primary printed products 42, 44 released by the transport device 34, drop in product pairs 42, 44 into the pocket or cell which has been designated by reference character 24' in FIG. 3. Since the rear sheet metal pocket or cell wall 92 is pressed by the action of the lever-cam arrangement 116, 122 against the abutment or stop element 148 the travel or drop path for the product pair 42, 43 is free so that the pair of printed products 42, 44 come into bearing contact with the sheet metal guide member 102 of the associated pocket or cell 24'. In order that such deposited pair of printed products 42, 44 does not shift in conjunction with the carriage 98 opposite the product conveying direction B, such are retained by any suitable guides or stops 260 in their axial position. Product retention guides or stops suitable for the stated purposes have also been disclosed in the aforementioned U.S. Pat. No. 4,058,202 and could also be here used. Shortly before the carriage or carriage member 98 assumes the position depicted in FIG. 4, the pocket or cell 24' has moved further in the direction of the arrow A to the position of the pocket or cell 24''' depicted in FIG. 3. The cam follower element 118 has reached the product clamping region or zone C, resulting in a pivoting or rocking of the actuation lever or lever member 116 and the rear sheet metal pocket or cell wall 92 in clockwise direction. As has been depicted for the pocket or cell 24'''' the pair of printed products 42, 44 is fixedly clamped between the slide surface or contact or cover member 140 and the clamping surface or contact or cover member 132. As soon as this has occurred, then the abutment or stop member 104 comes into contact with the entrainment lever member 158 and displaces the latter into the position depicted in chain-dot or phantom lines in FIG. 4. This motion is transferred to the gear rack 178 by the displacement rod 160 and the rotary joint or hinge member 168, and the tension spring 186 is loaded or stressed.

Now the movement of the gear rack or rack member 178 results in a rotation of the pinion member 176 in the clockwise direction which, in turn, leads to a displacement of the plunger member 180 in the product conveying direction B. This plunger member 180 acts upon the abutment or impact element 208 of the slide element or slider 142 and displaces this slide element 142 against the force of the return spring 202 also in the product conveying direction B. As a result, the printed product 44 which bears against the slide or contact surface 140 is displaced or shifted in the product conveying direction B in relation to the other printed product 42 which bears upon the clamping support or contact surface 132. Towards the end of the clamping region C the radius of the cam or cam member 122 again reduces. As a result, the rear sheet metal pocket wall or wall member 92 is pivoted in the counter-clockwise direction and the clamping support or contact member 132 is raised from the printed product 42. The direction of movement of the carriage or carriage member 98 is reversed, the gripper fingers 108 are rocked, so that the mutually shifted printed products 42 and 44, in other words the printed products of the product pair 42, 44 are further displaced in conjunction with the carriage 98 in the product conveying or conveyance direction B.

Due to the force of the tension spring 186 the displacement rod or rod member 160 as well as the plunger member 180 are returned back into their original rest position. The loaded or biased return spring 202 ensures that also the slide element 142 returns back into its rest position. During the remaining rotation of the cell wheel 12 the transport or feed device 88 transports the printed products 42 and 44 to the infeed section 16 and then returns back into the position depicted in FIG. 4, and the next printed product pair 42, 44 is again stuffed or inserted into the same pocket or cell 24, which in the considered illustration of FIG. 3 would be the pocket or cell 24'.

In the event that two printed products 42 and 44 are not to be processed conjointly with one another, rather only a single printed product must be processed, then the displacement or shifting devices 84 must be able to be blocked or rendered ineffectual. In order to achieve this result each associated entrainment lever member 158 is pivoted out of the region of the related abutment or stop member 104, as such has been depicted in FIG. 5. In this position the ball or sphere member 172 drops into the bore 170 in the non-depicted guide recess at the displacement rod 160 so that the displacement rod 160 is secured against rotation and pivoting about its lengthwise axis. In order to again activate or render effective the displacement or shifting device 84 of each pocket or cell 24, the related entrainment lever member 158 therefore must again be pivoted back into the chain-dot or phantom line position depicted in FIG. 5.

From the explanations given previously, it should be readily apparent that the explained processing of the printed products 42 and 44 is not limited to the described type of stuffing apparatus or machine. Instead of using a cell wheel or cell wheel unit 12 it is therefore possible to employ other types of equipment wherein the printed products 42, 44 pass through a linear, circular arc-shaped or arcuate or other type of two-dimensional processing path.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for stuffing at least one insert into folded printed products, especially for stuffing at least one insert into folded main printed products, comprising:

a transport device for the conjoint transport of two superposed printed products along a predeterminate processing path;

a displacement device for displacing the two superposed printed products relative to one another during the course of their movement along said predeterminate processing path;

said displacement device comprising a clamping element and a slide element;

means for bringing said clamping element into contact with an outer surface of one of the printed products of the two superposed printed products; and said slide element acting upon an outer surface of the other one of said two superposed printed products.

2. The apparatus as defined in claim 1, further including:

means for operatively connecting said transport device with said at least said slide element such that said slide element can be actuated by the transport device.

3. The apparatus as defined in claim 2, wherein:

said operatively connecting means include means for displacing said slide element in the direction of the predeterminate processing path.

4. The apparatus as defined in claim 1, further including:

means for displacing said slide element in the direction of the predeterminate processing path.

5. The apparatus as defined in claim 1, further including:

means for pivotably mounting said clamping element for movement from a product release position into a product clamping position and vice versa.

6. The apparatus as defined in claim 5, wherein:

said means for pivotably mounting said clamping element comprises structure for mounting said clamping element about an axis disposed substantially parallel to said predeterminate processing path.

7. The apparatus as defined in claim 5, further including:

means for pre-biasing said clamping element in the direction of a predeterminate product clamping position; and cam control means for placement of the clamping element in a product release position.

8. The apparatus as defined in claim 1, wherein:

each of said superposed printed products are displaceable in a predeterminate product conveying direction; and said transport device comprising carriage means displaceable in said predeterminate product conveying direction and opposite to said predeterminate product conveying direction.

9. The apparatus as defined in claim 8, further including:

means for displacing said slide element in the direction of the predeterminate processing path;

said slide element comprising a slide;

means for displaceably mounting said slide for movement in a direction substantially parallel to said predeterminate processing path;

said displacing means comprising drive means acting upon said slide; and said drive means being actuatable by said carriage means when said carriage means travels in a direction opposite to said predeterminate product conveying direction.

10. The apparatus as defined in claim 9, wherein:

said drive means comprises an entrainment lever member; said drive means further including abutment means provided for said carriage means; and said abutment means acting upon said entrainment lever member.

11. The apparatus as defined in claim 10, further including:

means for enabling pivoting of said entrainment lever member out of an effectual region of said abutment means.

12. The apparatus as defined in claim 9, wherein:

said drive means comprises gear rack means actuatable by said carriage means;

said drive means further including a rotatably mounted pinion operated by said gear rack means;

a plunger member provided with teeth means and acting upon said slide member; and said pinion converting the movement of the gear rack means into an oppositely directed movement of said plunger member.

13. The apparatus as defined in claim 12, wherein:

said drive means comprises an entrainment lever member;

said drive means further including abutment means provided for said carriage means;

said abutment means acting upon said entrainment lever member;

a displacement rod having a lengthwise axis;

said entrainment lever member being rigidly connected for rotation with said displacement rod;

lengthwise guide means for mounting said displacement rod for displacement movement in the direction of the lengthwise axis of the displacement rod and for pivotal movement about said lengthwise axis; and rotary joint means for operatively connecting said displacement rod with said gear rack means.

14. The apparatus as defined in claim 12, wherein:

said drive means comprises an entrainment lever member;

said drive means further including abutment means provided for said carriage means;

said abutment means acting upon said entrainment lever member; and spring means for pre-biasing said drive means in a rest position opposite to a predeterminate entrainment direction of the carriage means.

15. The apparatus as defined in claim 12, further including:

return spring means for pre-biasing said slide towards said plunger member.

16. The apparatus as defined in claim 1, further including:

a revolvingly driven cell wheel;

said revolvingly driven cell wheel comprising products;

said cell wheel having an axial direction of extent;

said cell wheel being divided in said axial direction of extent into successive sections defining an input section for the printed products, at least two infeed sections for delivering inserts to the printed products, and product removal section;

said at least two infeed sections being arranged between said input section and said product removal section;

said displacement device being arranged in said input section.

17. The apparatus as defined in claim 16, wherein:

said cell wheel has a predeterminate direction of rotation;

each pocket having a pocket rear wall and a pocket front wall;

one said displacement device being provided for each pocket;

said clamping element of each said displacement device, viewed in the predeterminate direction of rotation of the cell wheel, being arranged at the pocket rear wall; and said slide element of each said displacement device being arranged at said pocket front wall.

18. The apparatus as defined in claim 17, further including:

means for pivotably mounting each said clamping element for movement from a product release position into a product clamping position and vice versa;

cam control means for operating each of said clamping elements; and said cam control means comprising a cam member which coaxially engages about said cell wheel at the region of said input section.

19. The apparatus as defined in claim 9, further including:

means for pre-biasing said clamping element in the direction of a predeterminate product clamping position;

cam control means for placement of the clamping element in a product release position;

said clamping element having a product contact region;

said clamping element being provided at the product contact region with an adhesive clamping support; and said slide element being provided with an adhesive slide support.

20. The apparatus as defined in claim 19, wherein:

said clamping support has a surface;

said slide support has a surface; and said surfaces of said clamping support and said slide support being structured to define profiled surfaces.

21. The apparatus as defined in claim 20, wherein:

said clamping support is provided with a substantially sawtoothed-shaped profile;

said slide support is provided with a substantially sawtoothed-like profile; and each of said sawtoothed-like profiles having flank surfaces having at least predeterminate portions thereof extending at an inclination with respect to the predeterminate product conveying direction.

* * * * *